US005383320A

United States Patent [19]

Sorton

[11] Patent Number: 5,383,320

[45] Date of Patent: Jan. 24, 1995

[54] TOOL FOR POSITIONING JOIST HANGER ON HEADER

[76] Inventor: Steven W. Sorton, P.O. Box 221851, Carmel, Calif. 93922

[21] Appl. No.: 70,143

[22] Filed: Jun. 1, 1993

[51] Int. Cl.[6] ..... G01G 3/30

[52] U.S. Cl. ..... 52/749; 52/DIG. 1; 33/645

[58] Field of Search ..... 52/749 DR, DIG. 1 X, 52/DIG. 4; 33/613, 645 X, 533

[56] References Cited

U.S. PATENT DOCUMENTS 456,553 7/1891 Carr .
723,518 3/1903 Ellison .
804,067 11/1905 Stowe .
2,197,278 4/1940 Sverdahl .
2,891,318 6/1959 Harrison et al. .
2,911,022 11/1959 Brown .
2,960,953 11/1960 Schneider .
3,436,070 4/1969 Utley et al. .
3,673,664 7/1972 Niese .
4,131,268 12/1978 Valade .
4,340,100 7/1982 Anderson, II .
4,514,072 4/1985 Buckley .
4,753,014 6/1988 Vrajich .
4,947,616 8/1990 Sorton .

*Primary Examiner*—Carl D. Friedman
*Assistant Examiner*—Wynn E. Wood
*Attorney, Agent, or Firm*—Townsend and Townsend Khourie and Crew

[57] ABSTRACT

The present invention is directed to an improved tool for use in mounting a joist hanger on a header. The tool can be made to accommodate a joist hanger of a single size or can be made so as to be adjusted in size to accommodate joist hangers of different sizes. In the latter cases, a first set of bars can separate from the adjacent, second set of bars to expand the width of the space at the side of which a number of magnets are carried. This allows for greater versatility than when the bars are stationary.

11 Claims, 4 Drawing Sheets

TOOL FOR POSITIONING JOIST HANGER ON HEADER

BACKGROUND OF THE INVENTION

This invention relates to improvements in tools for mounting a joist hanger on a header.

In U.S. Pat. No. 4,947,616, a tool is described as having a generally vertical first member adjustably coupled with a second member. When properly adjusted, the members are located such that the second member rests on the upper face of a header to which a joist hanger is to be mounted. Magnets are coupled with the first member for releasably holding a joist hanger in place on the first member by magnetic attraction as the second member is supported on the upper margin of the header. Thus, the hanger can be nailed or otherwise fastened to the front face of the header, whereupon the first and second members can be removed as a unit from the header and placed at the next location along the header for mounting a joist hanger.

The second member of the tool of the patent can be removably coupled to the first member by an alignment structure. The alignment structure includes a pair of aligned, spaced pins projecting outwardly from the front face of the second member, the pins being received in an elongated slot extending longitudinally of and through the first member. The width of the first member can be chosen to accommodate a joist hanger having a specific set of dimensions.

While the tool described above is satisfactory for use in many construction situations, it has been found that improvements can be made to the tool to simplify the assembly and use of the tool. The present invention presents a tool which has such improvements.

SUMMARY OF THE INVENTION

The present invention is directed to an tool for use in mounting a joist hanger on a header. The tool has improvements over the structural features of the tool of the above patent. The tool can be made to accommodate a joist hanger of a single size or the tool can be made so as to be adjusted in size this allows the tool to accommodate joist hangers of different sizes. In the adjustable tool, a first set of vertical bars can separate from and remain parallel with an adjacent, second set of bars to expand the width of the space defined by the first set of bars on which a number of magnets are carried. This allows for greater versatility of the tool than when the bars are stationary.

Numerous objects of the present invention will become apparent as the following specification progresses, reference being had to the accompanying drawings for an illustration of the invention.

DETAILED DESCRIPTION OF THE PREFERRED EMBODIMENT

Figure 1:
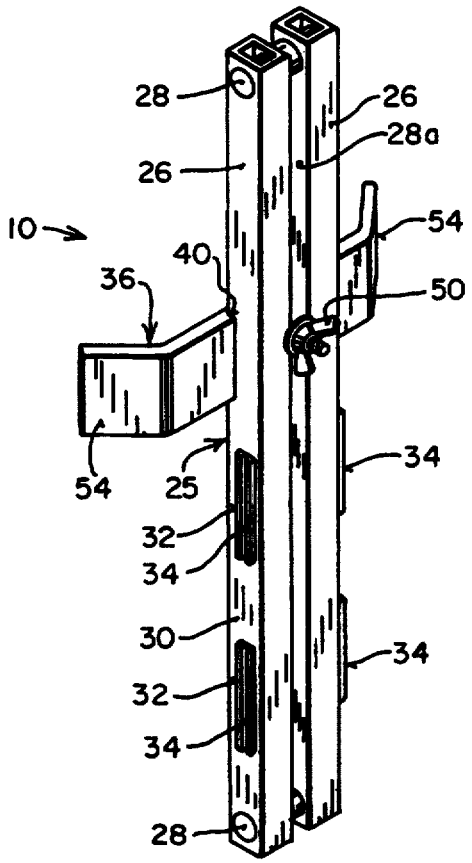
FIG. 1 is a perspective view of a first embodiment of the improved tool for use in attaching a joist hanger of a single size to a header.
Figure 2:
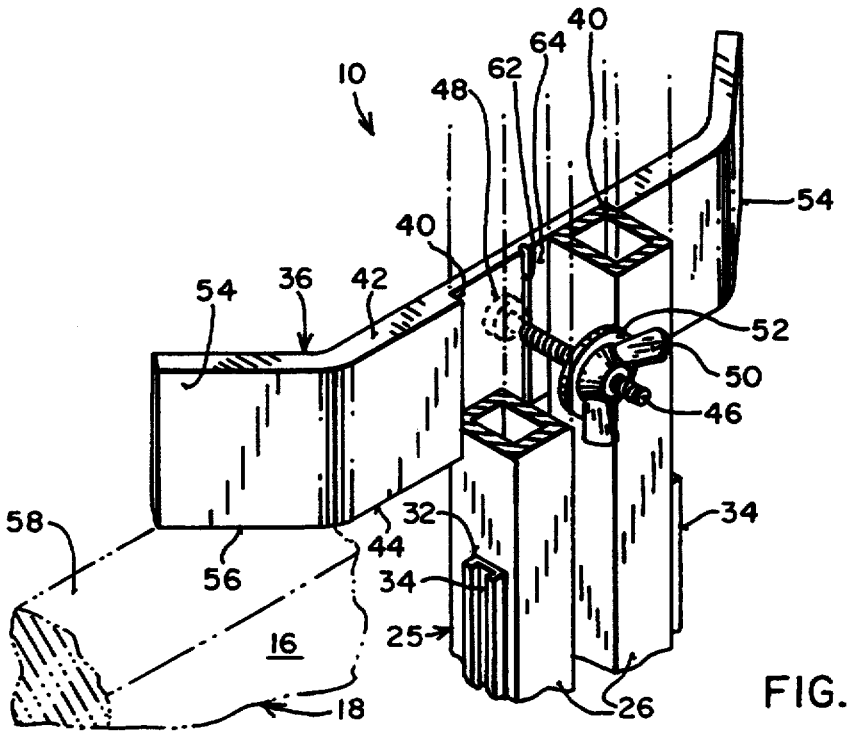
FIG. 2 is a view similar to FIG. 1 but on an enlarged scale, parts being broken away and in section to illustrate details of construction.
Figure 2A:
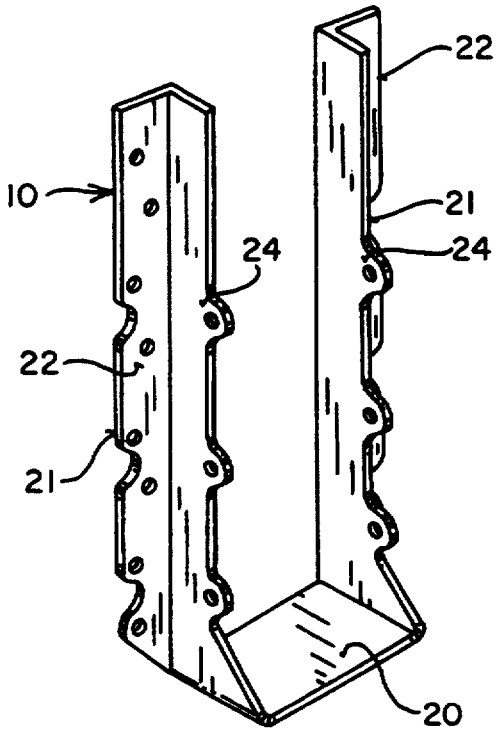
FIG. 2A is a perspective view of a joist hanger of the type which is used with the tool of FIGS. 1 and 2.
Figure 2B:
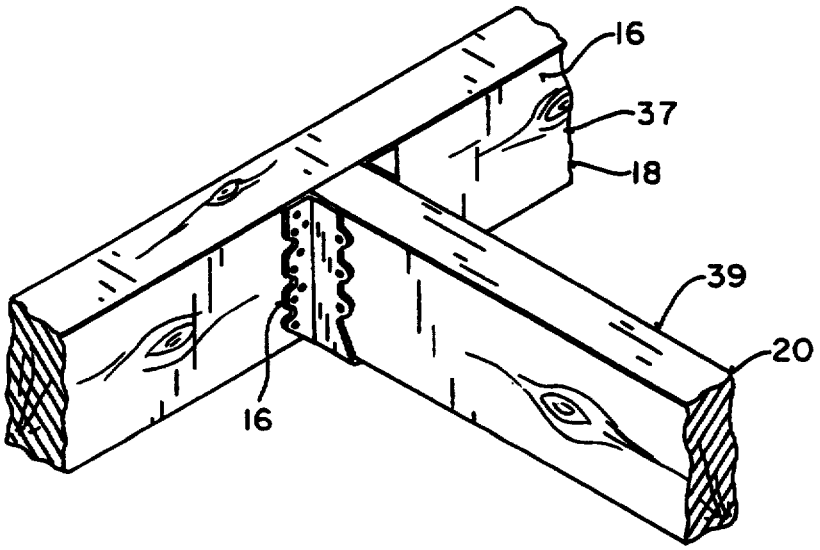
FIG. 2B is a perspective view of the joist hanger of FIG. 2A when the joist hanger is attached to a header and to a joist.
Figure 3:
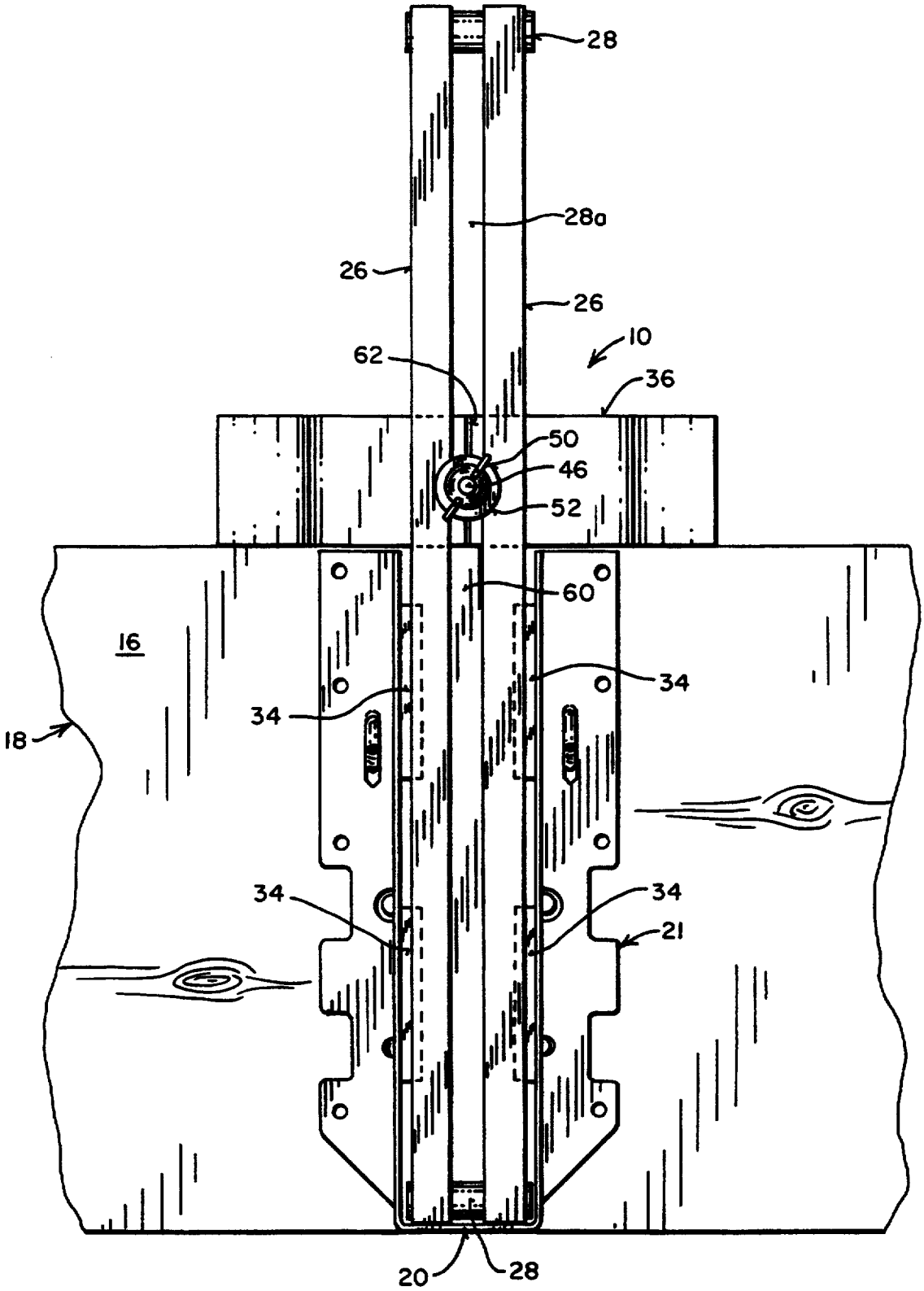
FIG. 3 is a front elevational view of the tool of FIGS. 1 and 2, showing the way in which the tool and hanger are positioned adjacent to the header of FIG. 2B.

A first embodiment of the tool of the present invention is broadly denoted by the numeral 10 and is shown in FIGS. 1, 2 and 3. Tool 10 is adapted to be used with a metallic joist hanger to position the joist hanger on the front side 16 of a header 18 (FIG. 2B), so that a joist 20 can be secured to the header 18 and can project outwardly therefrom at a substantially 90° angle as shown in FIG. 2B.

Joist hanger 12 is conventional in construction and has a pair of upright legs 21 with each leg having a first part 22 integral with a second part 24. Parts 22 and 24 are usually perpendicular to each other. Holes are formed in parts 22 and 24 to receive nails or other fasteners for attaching joist hanger 12 to header 18 and to joist 20, respectively, after tool 10 has been put into use. The metallic material of joist hanger 12 is magnetically susceptible.

Tool 10 is generally made of a metallic material such that it can be cut and machined with precision. Typically, the material will be non-ferrous metal, such as aluminum or plastic.

Tool 10 comprises a first member 25 having a pair of side bars 26 which are tubular and have a generally rectangular cross section as shown in FIG. 2. Bars 26 are of the same length and are interconnected at the upper and lower ends thereof by fasteners 28. When so fastened, the bars are parallel with each other and are spaced apart to present a vertical slot **28*a* between bars 26**.

Each bar 26 has a side face 30 which has elongated, rectangular openings 32 for receiving magnets 34 which are provided with outer faces which are substantially flush with the faces 30. The magnets are floating in the sense that they are not rigidly attached to the corresponding bar 30. The floating feature of the magnets allows them to be magnetically attracted to the legs 21 of a joist hanger 12 of the type shown in FIG. 2A. Any suitable means can be provided to mount the magnets in a floating condition in the corresponding bar 26. The fact that the magnets are floating allows the magnets to sometimes project slightly outwardly from the corresponding side face 30 of bar 26. Thus, joist hangers 12, which are irregular, can still be magnetically attracted to the magnets 34 and thereby be coupled to the tool itself. This feature also provides an auto means for easy removal of the tool once the hanger is nailed onto the header.

The bottom web 20 of the joist hanger 12 (FIG. 2A) engages the lower extremity of each of bars 26. Tool 10 further includes a second member 36 which has a relatively wide recess 38 machined therein to present a pair of spaced shoulders 40 at the sides of recess 38. Shoulders 40 extend from the upper flat face 42 of member 36 to the lower flat face 44 of member 36.

The recess 38 presents a space which receives bars 26 as shown in FIG. 2. Also, the second member 36 is shiftable along the length of bars 26 of first member 25 with substantially no relative side movement of member 36 with respect member 25.

To hold second member 36 to bars 26, a machine screw 46 is carried by member 36 midway between shoulders 40 and the screw 46 has a head 48 for engaging the opposite face of member 36. A wing nut 50, when threaded on screw 46, bears against a washer 52 and thereby couples member 36 to member 25 yet allows the member 36 to move longitudinally of member 25 when wing nut 50 has been loosened.

Each outer end of member 36 has an end segment 54 which is out of the plane of the central part 55 of member 36 to present a lower edge margin 56 capable of resting on the upper flat surface 58 of a header such as header 18 of FIG. 2B. An alignment groove 62 is formed in the face of member 36a. Groove 62 is adapted to be aligned with a pencil mark 60 made by the user of the tool.

In use, member 36 is mounted on member 25 and the members are held against relative movement by tightening wing nut 50. When so assembled, member 36 of the tool is placed on the upper flat surface 58 of header 18 in the manner shown in FIG. 3 such that the bottom flat face 56 of member 36 rests on surface 58 of the header.

A pencil mark 60 will have been made on the header 18 where it is desired to center the joist hanger 12. Alignment groove 62 will be centered with respect to slot 28a when the tool is properly positioned. Groove 62, machined in flat face 64 (FIG. 2), will be lined up with the pencil mark 60.

With the tool positioned on the header, the joist hanger 12 is moved into place with member 25 between the sides of the hanger. In this position of the hanger, the side parts 22 and 24 on the hanger will be magnetically attracted by the magnets 34 on bars 26. This magnetic attraction seats the hanger on member 25 with the bottom ends of bars 26 in engagement with the bottom web 20 of the hanger. As shown in FIG. 3, the magnets have been drawn out of bars 26 and are magnetically attracted to and engage the inner side surfaces of bars 26. This feature illustrates the fact that the hanger need not be precision made and it can still be attached or coupled to the tool 10 even though the hanger is irregular.

With the hanger properly positioned adjacent to side 16 of header 18, nails or other fasteners can be directed into holes in the hangers and the hangers are then secured to face 16 of the header. Then, the joist 27 can be attached to the hanger using suitable fasteners. Following this step, the attachment of the header and the joist is complete.

A second embodiment of the tool is denoted by the numeral 10a and is adapted to be used with joist hangers of different widths. The tool 10 of FIGS. 1–3 is adapted to position a joist hanger of a single size to the header.

Figure 4:
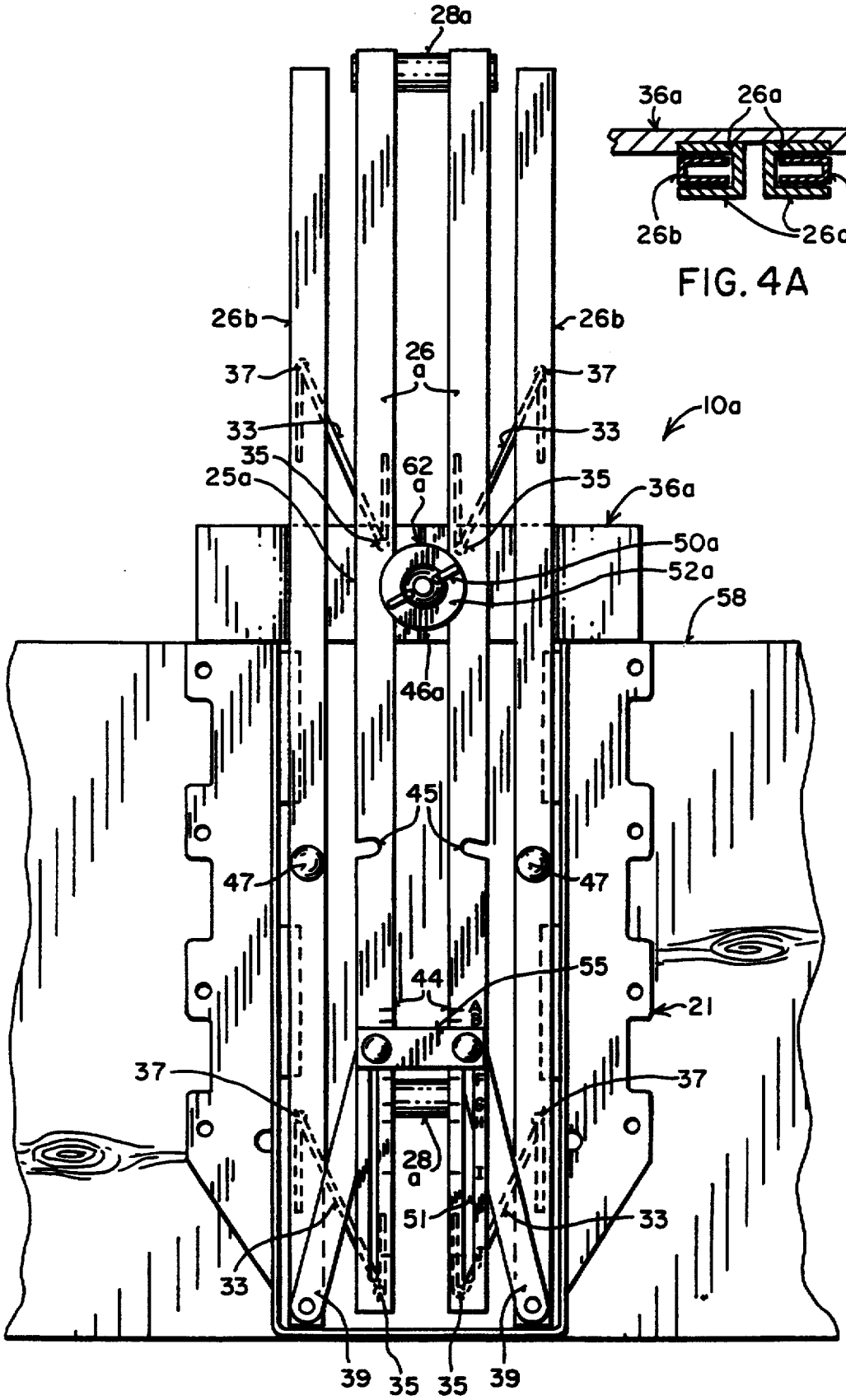
FIG. 4 is a view similar to FIG. 3 but illustrating a second embodiment of the tool of the present invention.

The tool of FIG. 4 includes a first member 25a which is coupled to a second member 36a by a machine screw 46a and a wing nut 50a. The tool 10a is adapted to be positioned adjacent to header 18 with member 36a resting on the upper surface 58 so that the index groove 62 in member 36a can be aligned with a pencil mark 60 which is drawn in the front face 16 of the header 18. To this extent, tool 10a operates in the same fashion as tool 10.

Figure 4A:
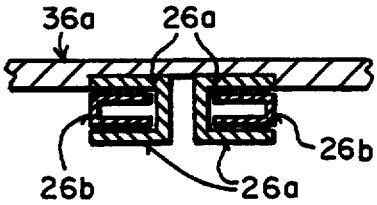
FIG. 4A is a fragmentary cross sectional view of the first member.

The primary difference between the two tools is that member 25a of tool 10a has a first pair of transversely U-shaped bars 26a and a second pair of transversely U-shaped bars 26b. Bars 26b are adapted to be telescopically received within corresponding bars 26a as shown in FIG. 4A. To this end, bars 26a are open at their outer sides, as shown in FIG. 4A. Bars 26a are connected by crosspieces 28a as shown in FIG. 4.

Bars 26b are pivotally coupled by links 33 to corresponding bars 26a. One end of each link has a pivot pin 35 coupled with the corresponding bar 26a and a second pivot pin 37 coupled with the corresponding bar 26b. In addition, end links 39 are provided to couple the lower end portions 41 of bars 26a to bars 26b to stabilize the pivotal connection between bars 26a and 26b. Links 33 therefore provides a parallelogram configuration for the member 25a in that bars 26a and 26b at all times remain parallel with each other regardless of the position of the bars 26b relative to corresponding bars 26a. Each bar 26b has a notch 45 formed therein for receiving a screw 47 which can is threadably coupled to the corresponding bar 26b and received in corresponding notch 45. In this way, bars 26b can be releasably secured in a collapsed condition to the corresponding bars 26a when the tool 10a is not in use.

Each of the bars 26b has a pair of spaced magnets 49 for magnetically attracting a joist hanger 12 when the bars 26b are at the proper position with respect to bars 26a. Magnets 49 can be floating, if desired, to accommodate for manufacturing defects in the sizes of the joist hangers used with tool 10a.

The lower portion 41 of each of bars 26b has a slot 51 therein for receiving a screw 53 threadably coupled to bar 26a to secure a crosspiece 55 to the bar 26a. The upper edge of crosspiece 55 can be mated with graduations 57 on lower portions 41 of bars 26a to provide for some type of rule whereby the setting of the bars 26b can be made before the joist hanger 12 is put into place on the tool. For instance, graduation A could be for a joist which is a 2×, such as 2×4, 2×6, 2×8, 2×10, 2×12, etc.; whereas, the corresponding graduation H could signify the size of the hanger for an 8×, such as 8×10, 8×12, 8×14, 8×16, etc., board. There could be a number of graduations designed for this purpose.

In use, the size and height of the joist hanger 12 will be selected in advance of mounting the hanger on tool 10a. If an 8× joist is selected, the tool is adjusted so that the lower edge of crossbar 55 is aligned horizontally with graduation H. The tool 20a would then be used in the same manner as that described above with respect to tool 10.

What is claimed is:

1. A tool for use in mounting a metallic joist hanger to a header having a side face comprising:

first and second members, said first member having a generally vertical slot, said second member having a lower surface adapted to rest on an upper face of the header, the hanger adapted to be secured to the header, the first member being adjacent to a side of the second member and to be located adjacent to a side face of the header when the second member is on said header, said first member having a magnetic structure thereon for magnetically coupling a joist hanger thereto to allow the joist hanger to be positioned adjacent to the side face of the header when the first member is adjacent to the side face;

means on said second member, including a pair of spaced shoulders for adjustably engaging the first member; and fastening means for adjustably securing the first member to the second member.

2. A tool as set forth in claim 1 wherein said second member has means defining a pair of vertically spaced marginal edges, said shoulders extending between the marginal edges.

3. A tool as set forth in claim 1 wherein said shoulders are defined by a pair of vertically extending, relatively flat shoulder surfaces.

4. A tool as set forth in claim 1, wherein said first member includes a pair of spaced bars, means interconnecting the ends of the bars to present a slot between the bars, said engaging means having the shoulders engageable with the outer faces of the bars.

5. A tool as set forth in claim 1, wherein the first member has said slot extending longitudinally thereof, said second member having a face aligned with the slot and provided with a groove in the face substantially parallel with and centered relative to the slot.

6. A tool as set forth in claim 5, wherein said fastening means includes a screw extending through the slot and through said first member and movable along the slot.

7. A tool as set forth in claim 1, wherein the width of the first member is substantially equal to the spacing between the shoulders of the second member.

8. A tool as set forth in claim 1, wherein said first member having a pair of magnets on the outer faces thereof.

9. A tool as set forth in claim 7, wherein said magnets are shiftably mounted on the first member, said magnets being capable of retracting flush with the second member and to extend outwardly therefrom.

10. A tool as set forth in claim 1, wherein said first member includes a pair of first bars, each first bar being open at the side, and a pair of second bars, there being a second bar for each first bar, respectively, the second bars being relatively telescoped in the first bars and movable outwardly therefrom, there being a linkage means pivotally mounting the second bar on each first bar, such that the second and first bars remain substantially parallel with each other regardless of the operative position of the second bars relative to the first bars, said magnetic structure including magnets carried by the second bars to accommodate joist hangers of different widths, and means for adjustably coupling the second bars to the first bars.

11. A tool as set forth in claim 10, wherein said coupling means includes a screw threaded into a respective first bar and bearing against the adjacent second bar.

* * * * *